US005496035A

United States Patent [19]

Gilchrist et al.

[11] Patent Number: 5,496,035

[45] Date of Patent: Mar. 5, 1996

[54] GOLF BALL CENTER

[75] Inventors: Herman T. Gilchrist; Sue C. Welsh, both of Ashland; Harvey A. McGowan, Mansfield; Gary A. Weller, Ashland; Richard T. Robertson, Nova, all of Ohio

[73] Assignee: Abbott Laboratories, Abbott Park, Ill.

[21] Appl. No.: 440,267

[22] Filed: May 12, 1995

Related U.S. Application Data

[63] Continuation of Ser. No. 114,559, Aug. 30, 1993, abandoned.

[51] Int. Cl.[6] ..... A63B 37/08

[52] U.S. Cl. ..... 273/231; 273/226

[58] Field of Search ..... 273/226, 227, 273/230, 231

[56] References Cited

U.S. PATENT DOCUMENTS

| | | | |
|---|---|---|---|
| 1,192,831 | 7/1916 | Knight | 273/226 |
| 3,490,770 | 1/1970 | Satchell et al. | 273/231 |
| 3,616,101 | 10/1971 | Satchell et al. | 29/899.1 |
| 4,244,855 | 1/1981 | Cox et al. | 260/33.6 AQ |
| 4,805,914 | 2/1989 | Toland | 273/231 |
| 4,904,320 | 2/1990 | Isaac et al. | 156/146 |
| 4,943,332 | 7/1990 | Sakaguchi et al. | 156/146 |
| 5,020,803 | 6/1991 | Gendreau et al. | 273/225 |
| 5,033,749 | 7/1991 | Kakiuchi et al. | 273/227 |
| 5,150,906 | 9/1992 | Molitor et al. | 273/231 |
| 5,338,038 | 8/1994 | Cadorniga | 273/216 |

FOREIGN PATENT DOCUMENTS

| | | |
|---|---|---|
| 60-241465 | 11/1986 | Japan . |
| 1376974 | 12/1974 | United Kingdom . |
| 2230703 | 10/1990 | United Kingdom . |

OTHER PUBLICATIONS

Aug. 1990, Sales Brochure from the Goodyear Tire & Rubber Co., Entitled "Goodyear Polybutadiene Polymers Turn Golf Tees . . . ".

1991, Sales Brochure from Union Carbide Specialty Chemicals Division Entitled "Polyox® Water–Soluble Resins–Applications".

Jun. 1980, Sales Brochure from Union Carbide Specialty Chemicals Division Entitled "Polyox® Water–Soluble Resins".

1991, Sales Brochure from Union Carbide Specialty Chemicals Division Entitled "Polyox® Water–Soluble Resins–Dissolving Techniques".

Undated Sales Brochure from Union Carbide Specialty Chemicals Division Entitled "How to Dissolve Polyox® Water–Soluble Resins".

Nov. 1991 Brochure from Union Carbide Specialty Chemicals Division Entitled "Material Safety Data Sheet for Polyox® Water–Soluble Resins".

*Primary Examiner*—George J. Marlo

*Attorney, Agent, or Firm*—Lonnie R. Drayer

[57] ABSTRACT

A liquid golf ball center has a spherical polymeric shell which contains a liquid mixture of water and a water soluble poly(ethylene oxide) polymer. The liquid mixture may also contain a substance for increasing the weight of the golf ball center.

20 Claims, 4 Drawing Sheets

GOLF BALL CENTER

This application is a continuation of application Ser. No. 08/114,559, filed Aug. 30, 1993, now abandoned.

The subject invention relates generally to an improved center for a golf ball, more specifically to a new liquid golf ball center, and to golf balls which contain the improved centers.

Due to the difficulty and popularity of the game of golf, manufacturers of golf balls have consistently sought ways to improve golf ball performance. At the present time, there are primarily two types of golf balls. The first type is a two-piece golf ball, and the second type comprises a spherical golf ball center about which is wound rubber yarn. Furthermore, there are two broad categories of spherical golf ball centers which may be assembled with rubber yarn and an external cover to make a golf ball. One type of golf ball center is a solid sphere, usually comprised of a polymeric material. A second type of golf ball center comprises a spherical rubber shell containing a liquid. Liquid center golf balls are often preferred by the most skilled golfers, such as professionals or highly skilled amateurs. The perceived advantage of a liquid center golf ball is the good control and accuracy it affords. While the difference between the various types of golf balls might seem subtle, they can be important to golfers who compete at the highest skill level.

As used herein and in the claims a "liquid" is understood to be a non-solid material which maintains its volume and assumes the shape of its container, and may be a gel or a paste. A "gel" has the aforementioned characteristics of a liquid and is a colloid in which the disperse phase has combined with the continuous phase to produce a jelly-like product, or put another way a solute forms sub-microscopic crystalline particle groups which retain much solvent in the spaces between the particles. A "paste" is a thick, dough-like substance having the aforementioned characteristics of a liquid. The liquid contained in the golf ball centers of the present invention has not been classified as either a gel or a paste, but it is a very thick liquid material which is suggestive of a paste or a gel.

U.S. Pat. No. 4,943,332 to Sakaguchi et al. discloses a method of producing a liquid-filled center for a golf ball. The method is characterized in that an adhesive is coated on the edge surfaces of a pair of rubber hemispheres. The hemispheres are combined in a liquid material and then vulcanized. The golf ball centers of the present invention may be manufactured using a process similar to that disclosed in U.S. Pat. No. 4,943,332.

There are numerous patents relating to liquid golf ball centers. U.S. Pat. No. 5,150,906, for instance, discloses a liquid golf ball center containing a mixture of gelatin, sugar and water. Other liquid golf ball centers are disclosed in U.S. Pat. Nos. 1,192,831; 3,490,770; 3,616,101; 4,805,914; 4,904,320; 5,020,803; and 5,033,749. GB patent publications 1,376,974 and 2,230,703A also disclose liquid golf ball centers. Published Japanese patent application Kokai Sho 60-241465, published in 1986, discloses yet another liquid golf ball center. However; none of these publications discloses a liquid golf ball center containing a poly (ethylene oxide) polymer as in the present invention.

A golf ball center in accordance with the present invention has a polymeric spherical shell which is filled with a liquid comprising a water soluble poly (ethylene oxide) polymer and water. Depending upon the desired weight of the golf ball center (in order that the golf ball may meet the weight specification of the governing sports association), the liquid may further comprise another substance to increase the weight of the golf ball center.

The features of the invention which are believed to be novel are set forth with particularity in the appended claims. The present invention, both as to its structure and manner of operation, may best be understood by reference to the following detailed description, taken in accordance with the accompanying drawings in which:

Figure 1:
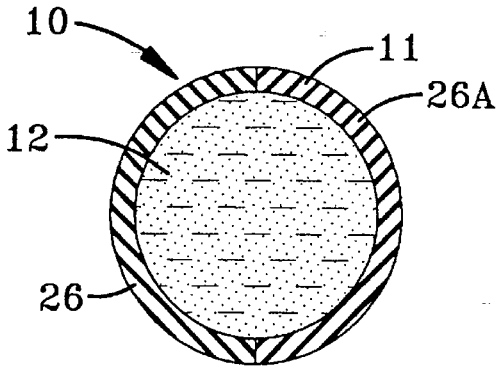
FIG. 1 is a cross-sectional view of a golf ball center in accordance with the present invention.

With reference to FIG. 1 the golf ball center 10 of the present invention comprises a spherical shell 11 which is comprised of a first hemisphere 26 and a second hemisphere 26A which are preferably made of a suitable polymeric material such as rubber. The first hemisphere has an edge and the second hemisphere has an edge. The edges are joined together during one step of the manufacturing process to form a spherical shell.

By means of example only the spherical shell may comprise any suitable polymeric compound such as:

| | |
|---|---|
| Butadene 1207 | 100.00 parts |
| Sartomer 416 (Zinc Salt) | 30.00 parts |
| Zinc Oxide | 18.00 parts |
| Zinc Stearate | 6.00 parts |
| Di-Cup 40C (Vulcanizing Agent) | 3.00 parts |

It is understood that any suitable polymeric compound may be used in the practice of the present invention so long as it meets the specifications of the golf ball manufacturer. Other examples of polymeric compounds suitable for use as shells of liquid golf ball centers are taught, for example, in U.S. Pat. No. 4,244,855.

Figure 2:
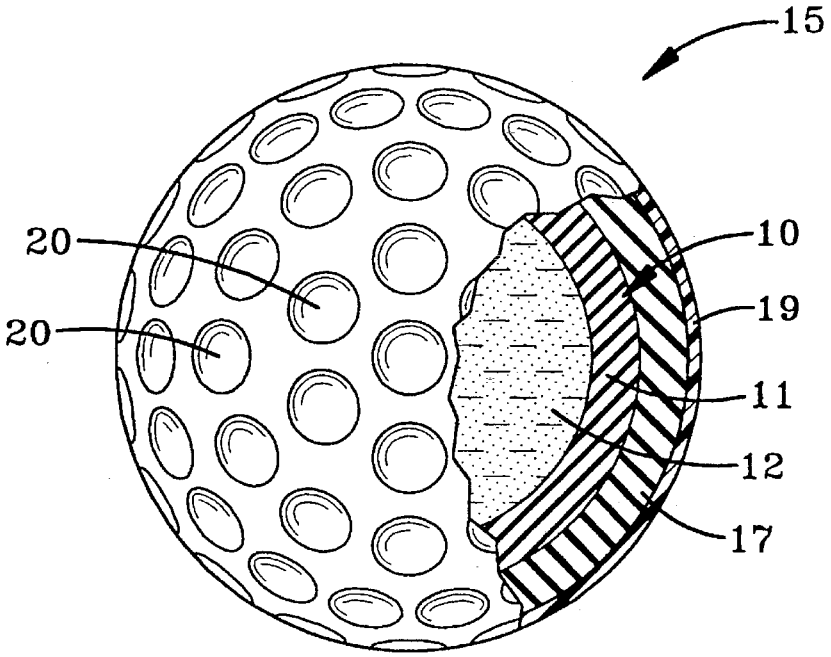
FIG. 2 is a golf ball, partially broken away to reveal its interior structure, which includes a golf ball center in accordance with the present invention.

With reference next to FIG. 2, there is shown, partially broken away, an example of a golf ball 15 which employs a golf ball center 10 of the present invention. Radially outwardly of the golf ball center 10 is a series of rubber threads 17 which are wound about the spherical golf ball center. Radially outwardly of the rubber threads is a cover 19. The cover features dimples 20, as is common in the current state of the art golf ball covers.

By means of example only, a spherical golf ball center in accordance with the present invention may have an outside diameter in the range of about 1.05" to 1.10"; the spherical shell 11 has a thickness of about 0.090"; and the total weight of the golf ball center is about 16.2 to 17.2 grams. It is understood, of course, that these dimensions may be varied in accordance with the requirements of a golf ball manufacturer since the golf ball center is only one component of a more complex golf ball structure.

The spherical shell 11 encloses a liquid 12 comprising water and a water soluble poly (ethylene oxide) polymer. While any suitable soluble poly (ethylene oxide) polymer may be used, the preferred poly(ethylene oxide) polymer is available from the Union Carbide Chemicals & Plastic Co., Inc., Specialty Chemicals Division, 39 Old Ridgebury Road, Danbury, Conn., 06817-0001, U.S.A. The preferred poly-(ethylene oxide) polymer is sold by Union Carbide under the trademark of Polyox®. Polyox® is a registered trademark of the Union Carbide Chemicals & Plastics Tech. Corp. Polyox® water soluble resins, CAS Registry No. 25322-68-3, are nonionic water-soluble poly (ethylene oxide) polymers which are available in a variety of viscosity grades. The degree of polymerization, n, varies from about 2,000 to about 180,000, depending on the viscosity grade of the resin. All Polyox® water-soluble resins have this common structure:

$$(OCH_2CH_2)n\ OH$$

Polyox® water soluble resins are extremely effective thickening agents in water. Polyox® water soluble resins are produced and supplied as white, granular powders, possessing a slightly ammoniacal odor. The preferred grade of Polyox® is WSR Coagulant with an approximate molecular weight of 5,000,000. In the preferred embodiment, the viscosity range in mPa scc (cP), in an aqueous solution at 25° C., when tested on a Brookfield Viscometer, Model RBF, measured with a Number 7 spindle at 20 rpm, was between 50,000 centipoise and 1,000,000 cP, with a nominal viscosity being about 100,000 cP. The preferred poly(ethylene oxide) has a melting point of about 62°–67° C. in a density bulk of 31 lbs./ft.$^3$ In a preferred embodiment the tablet comprises by weight 49.5% of the water soluble poly (ethylene oxide) polymer; 49.5 sucrose; and 1% stearic acid. The stearic acid is a processing aid used in the manufacture of the tablets. The sucrose is a substance used to add weight to the golf ball center in order that the complete golf ball structure may meet the weight requirements of a governing sports association. While the sucrose is an organic compound, other substances that may be used in the liquid composition of matter to adjust the weight of the golf ball center include, for example, fructose, barium sulfate, bismuth trioxide, bismuth subcarbonate and zinc oxide.

The viscosity of samples of the various liquid compositions of matter contained in the polymeric spherical shell of the new golf ball centers were evaluated using a Brookfield RVFD Viscometer. A variety of spindles were employed in the viscosity tests. The results of the viscosity tests are presented in Tables 1 and 2.

TABLE 1

| SAMPLE NO. | SUCROSE | POLYOX ® (g/100 g of water) | STEARIC ACID | SPINDLE NO. | RPM | VISCOSITY (cps) |
|---|---|---|---|---|---|---|
| 1 | 11.93 | 11.93 | 0.24 | 7 | 20 | 168,600 |
| 2 | 23.85 | 0.0 | 0.24 | 7 | 20 | 0 |
| | | | | 1 | 20 | 6 |
| 3 | 0.0 | 23.85 | 0.24 | 7 | 20 | Too thick to measure |
| | | | | 7 | 4 | " |
| 4 | 2.29 | 21.57 | 0.24 | 7 | 20 | Too thick to measure |
| | | | | 7 | 4 | " |
| 5 | 21.57 | 2.29 | 0.24 | 7 | 20 | 1,800 |
| | | | | 3 | 20 | 1,615 |
| | | | | 2 | 20 | 1,522 |
| 6 | 7.11 | 16.75 | 0.24 | 7 | 20 | Too thick to measure |
| | | | | 7 | 4 | " |
| 7 | 16.75 | 7.11 | 0.24 | 7 | 20 | 39,800 |
| | | | | 6 | 20 | 25,150 |

TABLE 2

| SAMPLE NO. | FRUCTOSE | POLYOX ® (g/100 g of water) | STEARIC ACID | SPINDLE NO. | RPM | VISCOSITY (cps) |
|---|---|---|---|---|---|---|
| 1 | 11.93 | 11.93 | 0.24 | 7 | 20 | 106,800 |
| 2 | 23.85 | 0.0 | 0.24 | 7 | 20 | 0 |
| | | | | 1 | 20 | 6 |
| 3 | 0.0 | 23.85 | 0.24 | 7 | 20 | Too thick to measure |
| | | | | 7 | 10 | 244,800 |
| 4 | 2.29 | 21.57 | 0.24 | 7 | 20 | 6,900 |
| | | | | 5 | 20 | 5,320 |
| 5 | 21.57 | 2.29 | 0.24 | 7 | 20 | 200 |
| | | | | 2 | 20 | 92 |
| | | | | 1 | 20 | 114 |
| 6 | 7.11 | 16.75 | 0.24 | 7 | 20 | 95,800 |
| 7 | 16.75 | 7.11 | 0.24 | 7 | 20 | 8,800 |
| | | | | 4 | 20 | 7,830 |

The force required to compress the outside diameter a golf ball center according to the preferred embodiment by 10mm is in the range of about 2.2 Kgs to about 4.0 Kgs.

Figure 3:
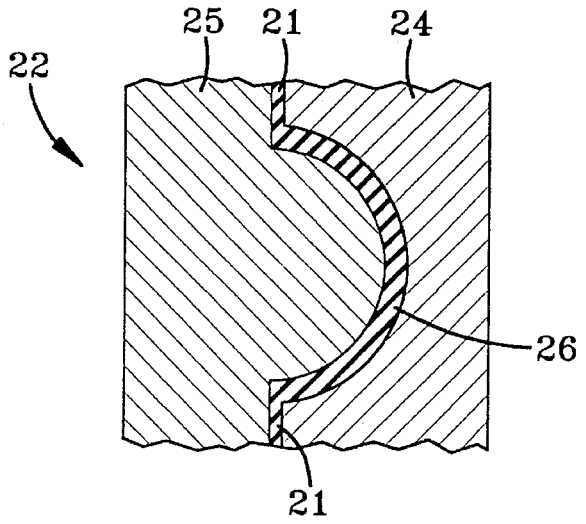
FIG. 3 is a fragmentary cross-sectional view of a molding apparatus used in the manufacture of a hemisphere of a spherical shell used in the golf ball center of the present invention.

A preferred method of manufacturing a golf ball center in accordance with the present invention will now be described with reference to FIGS. 3–8. With reference first to FIG. 3 there is shown a fragmentary cross-sectional view of a mold 22 used to manufacture the hemispheres. The mold forms a sheet with an array of hemispheres joined to one another by a connecting web 21. Only one hemisphere forming cavity defined by the two mating mold members 24 and 25 are shown in FIG. 3. Slugs of a suitable polymeric material are placed in the depressions in the female mold member 24, which is then mated with the male mold member 25 to form a hemisphere 26. The mold is heated such that a desired degree of vulcanization is imparted to the polymeric hemisphere. The degree of vulcanization may be complete, or preferably partial with further vulcanization to be carried out in a later step as described in the following text.

Figure 4:
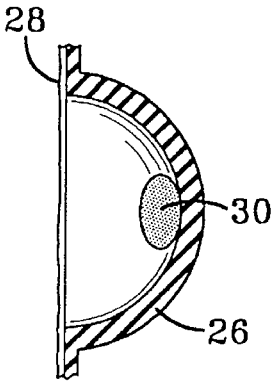
FIG. 4 is a cross-sectional view of the hemisphere molded in FIG. 1 after it has been removed from the molding apparatus, with a tablet containing a water soluble poly (ethylene oxide) polymer adhered to the inside of the hemisphere.

The array of web-connected hemispheres is then removed from the molding apparatus. As shown in FIG. 4 the edges of each hemisphere 26 are coated with a vulcanizable rubber adhesive 28, or any other suitable adhesive. In the preferred embodiment, a liquid composition is formed by mixing a solid tablet 30, containing a poly(ethylene oxide) polymer, with water. In the preferred embodiment, the tablet is placed into one of the hemispheres. The tablet 30 is held in a hemisphere by a drop of water which partially dissolves the tablet to form a sufficiently adhesive bond to secure the tablet adjacent to the hemisphere during the manufacturing process. Subsequently, the hemispheres are filled with an aqueous solution. The tablet will later dissolve in the aqueous solution within the sphere. As used herein and in the claims, an "aqueous solution" is understood to be a liquid composition of matter which comprises greater than 50% water by weight. It is understood that the poly (ethylene oxide polymer) may be placed in a gelatin capsule which is held in a hemisphere by an adhesive, or that the tablet may be held in place by an adhesive.

Figure 5:
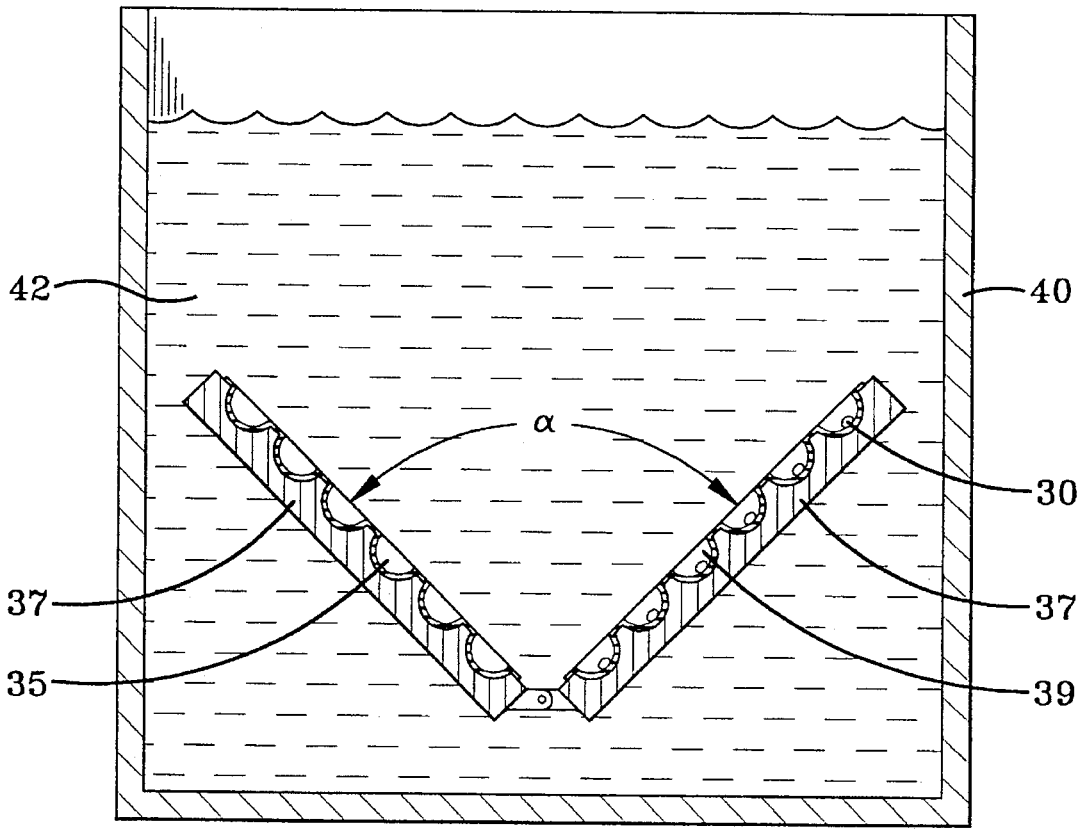
FIGS. 5–7 are cross-sectional views of an apparatus used for assembling the hemispheres together and filling the resultant spherical shell with a liquid.
Figure 6:
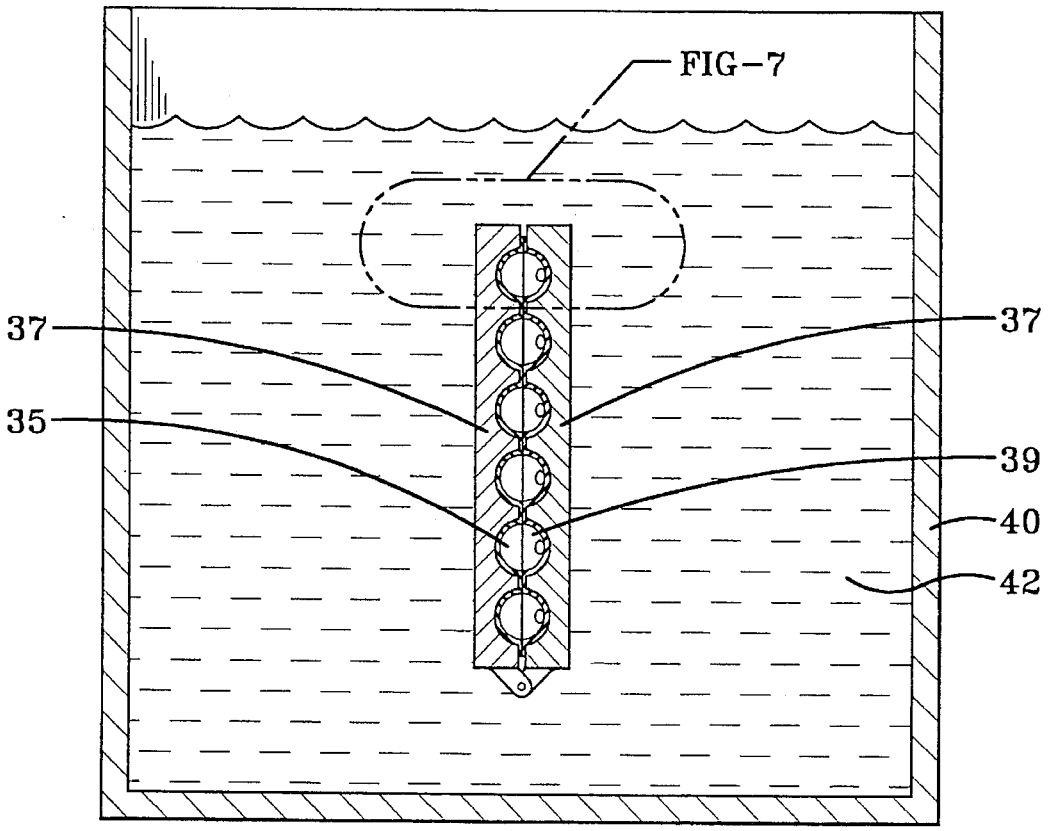
Figure 7:
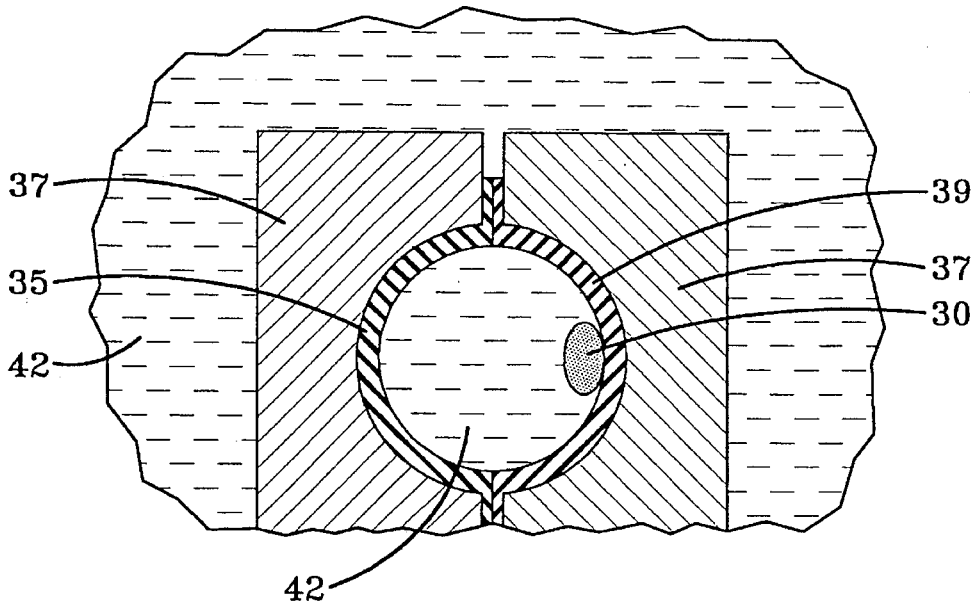

With reference to FIGS. 5–7 in the next stage of the manufacturing process, a first array of web hemispheres 35 is loaded in one half of a hinged closing tool 37 and a second array of web-connected hemispheres 39 is loaded into the second half of the closing tool 37. In the preferred embodiment, the closing tool halves are angled so that the hemispheres are retained in the proper position within the closing tool. In the preferred manufacturing method, the angle $\alpha$ between the closing tool halves is about 60 degrees. This angle $\alpha$ was chosen to ensure that air bubbles within the hemispheres are allowed to escape. One of the arrays of web-connected hemispheres 39 already having a tablet 30 secured in each hemisphere by an adhesive. The closing tool halves of closing tool are then submerged into a closing tank 40. The closing tank 40 contains an aqueous solution 42. In the preferred embodiment described herein the aqueous solution is water. At this point, the two halves of closing tool are aligned and joined together. This process is completed while the closing tool halves are still submerged in the aqueous solution. By joining the closing tool halves, the respective edges of the first and second hemispheres are joined together. Note that the tablet 30 is contained within the spherical shell which is completely filled with water and has little or no air within it.

Next the closing tool is withdrawn from the closing tank and the array of web-connected golf ball centers is removed from the closing tool. Even though the hemispheres are at this point only joined by an adhesive, not yet chemically bonded, they remain joined together to form spheres.

Figure 8:
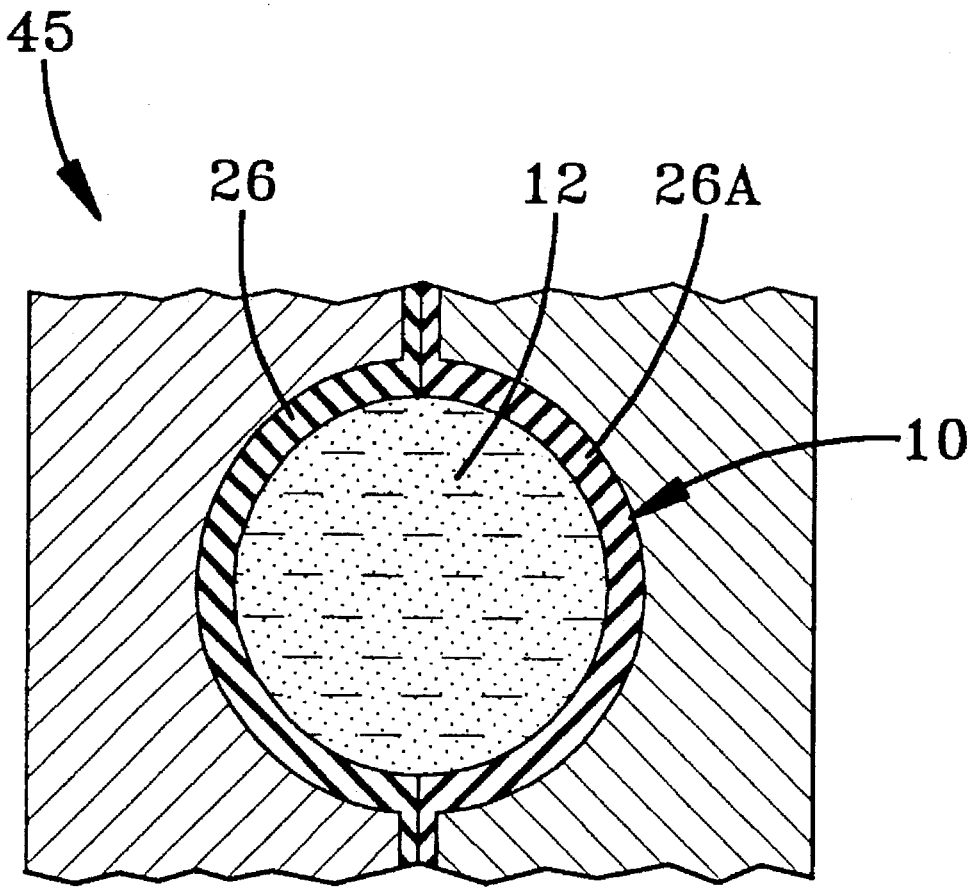
FIG. 8 is a cross-sectional view of a vulcanizing apparatus used to permanently unite the hemispheres together.

With reference to FIG. 8, an array of web-connected golf ball centers 10 is now loaded into a vulcanizing mold 45. The polymeric spherical shells 11 are now fully vulcanized, joining the hemispheres 26, 26A into a essentially homogeneous structure.

The golf ball centers are then removed from the vulcanizing mold. The golf ball centers are then separated from one-another using a cutting die.

The poly (ethylene oxide) polymer in the tablet dissolves combines with the aqueous solution (in this example water) within the spherical shell to form a liquid composition.

The invention has been described with reference to preferred embodiment. Modifications or alterations of the embodiment disclosed herein will be apparent to those skilled in the art upon a reading and understanding of the disclosure and drawings. It is intended that all such modifications of the invention being included within the scope of the appended claims to the degree allowed by the United States Patent Law.

We claim:

1. A golf ball center comprising a spherical polymeric shell which surrounds a liquid composition of matter, said liquid composition of matter comprising water and a water soluble poly (ethylene oxide) polymer.

2. A golf ball center as described in claim 1 wherein said liquid composition of matter further comprises a substance for increasing the weight of the golf ball center.

3. A golf ball center as described in claim 2 wherein said substance for increasing the weight of the golf ball center is selected from the group consisting of sucrose, fructose, barium sulfate, bismuth trioxide, bismuth subcarbonate and zinc oxide.

4. A golf ball center comprising a spherical polymeric shell which surrounds a liquid composition of matter, said liquid composition of matter comprising water and a water soluble poly (ethylene oxide) polymer, said liquid composition of matter comprising by weight at least 7% of said poly (ethylene oxide) polymer.

5. A golf ball center as described in claim 4 wherein said liquid composition of matter comprises by weight at least 12% of said poly (ethylene oxide) polymer.

6. A golf ball center according to claim 4 wherein said liquid composition of matter further comprises a substance for increasing the weight of the golf ball center.

7. A golf ball center as described in claim 5 wherein said liquid composition of matter further comprises a substance for increasing the weight of the golf ball center.

8. A golf ball center as described in claim 6 wherein said substance for increasing the weight of the golf ball center is selected from the group consisting of sucrose, fructose, barium sulfate, bismuth trioxide, bismuth subcarbonate and zinc oxide.

9. A golf ball center as described in claim 7 wherein said substance for increasing the weight of the golf ball center is selected from the group consisting of sucrose, barium sulfate, bismuth trioxide, bismuth subcarbonate and zinc oxide.

10. A golf ball center as described in any one of claims 4–9 wherein the force required to compress the outside diameter of the golf ball center by 10 mm is in the range of about 2.2 kgs to about 4.0 kgs.

11. A golf ball center comprising a spherical polymeric shell which surrounds a liquid composition of matter, said liquid composition of matter comprising water, a water soluble poly (ethylene oxide) polymer and an organic substance for increasing the weight of the golf ball center.

12. A golf ball center as described in claim 11 wherein the force required to compress the outside diameter of the golf ball center by 10 mm is in the range of about 2.2 kgs to about 4.0 kgs.

13. A golf ball center as described in either of claims 11 or 12 wherein the organic substance in said liquid composition of matter is selected from the group consisting of sucrose and fructose.

14. A golf ball center as described in claim 13 wherein the polymeric shell comprises rubber.

15. A golf ball comprising a golf ball center which comprises a polymeric spherical shell which surrounds a liquid composition of matter, said liquid composition of matter comprising water and a water soluble poly (ethylene oxide) polymer.

16. A golf ball comprising a golf ball center which comprises a spherical polymeric shell which surrounds a liquid composition of matter, said liquid composition of matter comprising (a) water, (b) a water soluble poly (ethylene oxide) polymer, and (c) a substance for increasing the weight of the golf ball center.

17. A golf ball as described in claim 16 wherein said substance for increasing the weight of the golf ball center is selected from the group consisting of sucrose, fructose, barium sulfate, bismuth trioxide, bismuth subcarbonate and zinc oxide.

18. A golf ball comprising a golf ball center which comprises a spherical polymeric shell which surrounds a liquid composition of matter, said liquid composition of matter comprising (a) water, (b) a water soluble poly (ethlene oxide) polymer and (c) an organic substance for increasing the weight of the golf ball center.

19. A golf ball as described in claim 18 wherein the organic substance in said liquid composition of matter is selected from the group consisting of sucrose and fructose.

20. A golf ball as described in either of claims 18 or 19 wherein the force required to compress the outside diameter of the golf ball center by 10 mm is in the range of about 2.2 kgs to about 4.0 kgs.

* * * * *